United States Patent [19]

Ueda

[11] Patent Number: 4,625,371

[45] Date of Patent: Dec. 2, 1986

[54] SEAT BELT BUCKLE

[75] Inventor: Takeo Ueda, Kanagawa, Japan

[73] Assignee: NSK-Warner K.K., Japan

[21] Appl. No.: 783,349

[22] Filed: Sep. 27, 1985

[30] Foreign Application Priority Data

Nov. 22, 1984 [JP] Japan ..... 59-176651[U]

[51] Int. Cl.[4] ..... A44B 11/25

[52] U.S. Cl. ..... 24/641; 24/639; 24/650; 24/656

[58] Field of Search ..... 24/641, 642, 643, 647, 24/650, 652, 655, 656, 636, 637, 638, 639

[56] References Cited

U.S. PATENT DOCUMENTS

| | | | |
|---|---|---|---|
| 3,514,821 | 6/1970 | Saxmark | 24/641 |
| 3,579,750 | 5/1971 | Carbon et al. | 24/650 |
| 3,597,811 | 8/1971 | Cunningham | 24/650 |
| 3,851,360 | 12/1974 | Minolla | 24/639 |
| 3,935,618 | 2/1976 | Foehl | 24/639 |
| 4,134,186 | 1/1979 | Krautz | 24/641 |
| 4,194,764 | 3/1980 | Grimm | 24/656 |
| 4,208,771 | 6/1980 | Biller | 24/639 |
| 4,408,374 | 10/1983 | Foehl | 24/650 |

FOREIGN PATENT DOCUMENTS

| | | | |
|---|---|---|---|
| 3019142 | 11/1981 | Fed. Rep. of Germany | 24/650 |

*Primary Examiner*—Victor N. Sakran

*Attorney, Agent, or Firm*—Wegner & Bretschneider

[57] ABSTRACT

In a safety belt for a car or the like, a buckle is provided to receive a tongue releasably. The buckle includes a latch member engageable with the tongue, a U-shaped base defining an opening in the direction of insertion of the tongue and supporting the latch member turnably, and a bridge secured to the lower end of the base and having engagement portions which when the tongue is in a state kept in engagement with the latch member, are kept in engagement with the tongue at two points. Owing to this structure, the tongue can be firmly held without play and the buckle can withstand large forces and moments applied thereto by way of the tongue.

9 Claims, 4 Drawing Figures

SEAT BELT BUCKLE

BACKGROUND OF THE INVENTION (1) Field of the Invention

This invention relates to a buckle of a safety belt system employed in a car or the like, and more specifically to a buckle structure adapted to receive and hold its associated tongue in place.

(2) Description of the Prior Art

A buckle, which is adapted to hold in place its associate webbing or webbings of a safety belt system for a vehicle such as car, is required to withstand sudden applications of tensile forces without failure and at the same time to permit smooth fastening and release by small power in view of its application purpose. Although a variety of buckles have heretofore been proposed and used, it can hardly be said that the above-mentioned requirements can be satisfied by a structure which is convenient for handling, relatively simple and small.

SUMMARY OF THE INVENTION

With the foregoing in view, the present invention has been completed. It is an object of this invention to provide a buckle having a simple structure, permitting easy assembly and enjoying fail-free holding performance.

In one aspect of this invention, there is thus provided a buckle for releasably receiving a tongue which defines an engagement recess. The buckle comprises:

a latch member engageable with the engagement recess;

a base formed in a substantially U-like configuration so as to define an opening in the direction of insertion of the tongue and defining through both side walls thereof support slots for turnably supporting the latch member, said base being adapted to receive the tongue therein;

a bridge secured on the base and extending in the opening of the base, said bridge having engagement portions which when the tongue is in a state kept in engagement with the latch member, are kept in engagement with both first and second portions of the tongue so as to hold the tongue in a received position, said first portion extending from the engagement recess of the tongue toward the leading edge of the tongue and said second portion extending in the opposition direction from the engagement recess;

a biasing member for biasing the latch member so that the latch member assumes a latch position where the latch member is engageable with the engagement recess of the tongue; and release means for turning the latch member against the biasing force of the biasing member so as to release the latch member from the latch position.

According to this invention, the tongue-receiving space is formed by firmly fixing, on the U-shaped base, the bridge as an additional wall member which also serves as a support member for the tongue. Therefore, it is possible to manufacture with ease a strong buckle which can successfully withstand forces and moments exerted abruptly thereto by way of its associated tongue and can hence hold the tongue without failure.

The above and other objects, features and advantages of the present invention will become apparent from the following description and the appended claims, taken in conjunction with the accompanying drawings.

DETAILED DESCRIPTION OF THE INVENTION AND PREFERRED EMBODIMENTS

Figure 1:
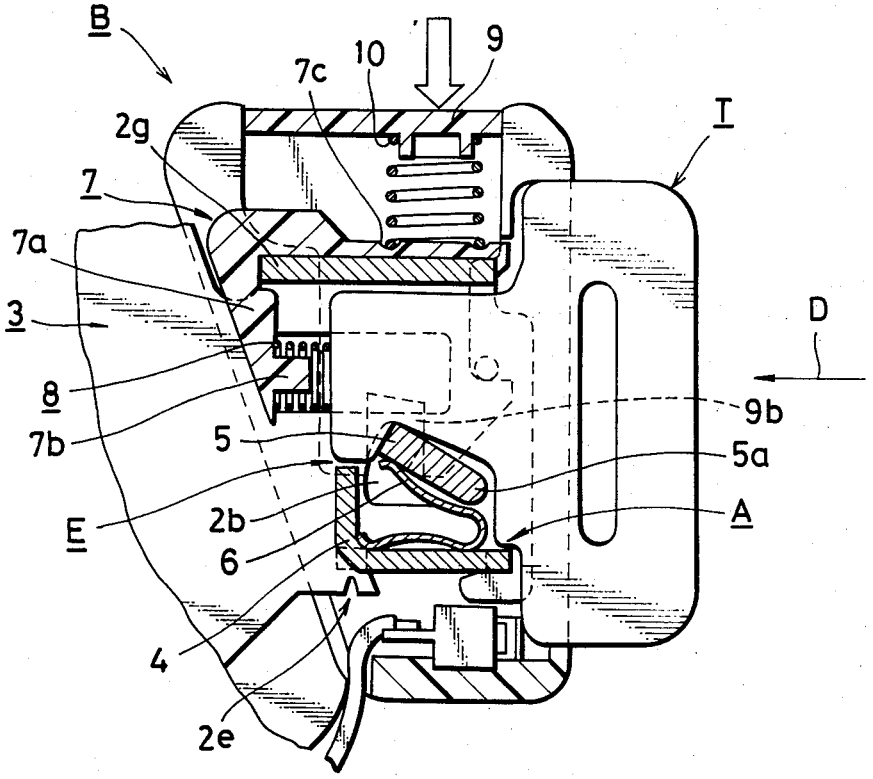
FIG. 1 is a cross-sectional front view of a buckle according to one embodiment of this invention and its associated tongue, in which the tongue has been inserted and fastened to the buckle.
Figure 2:
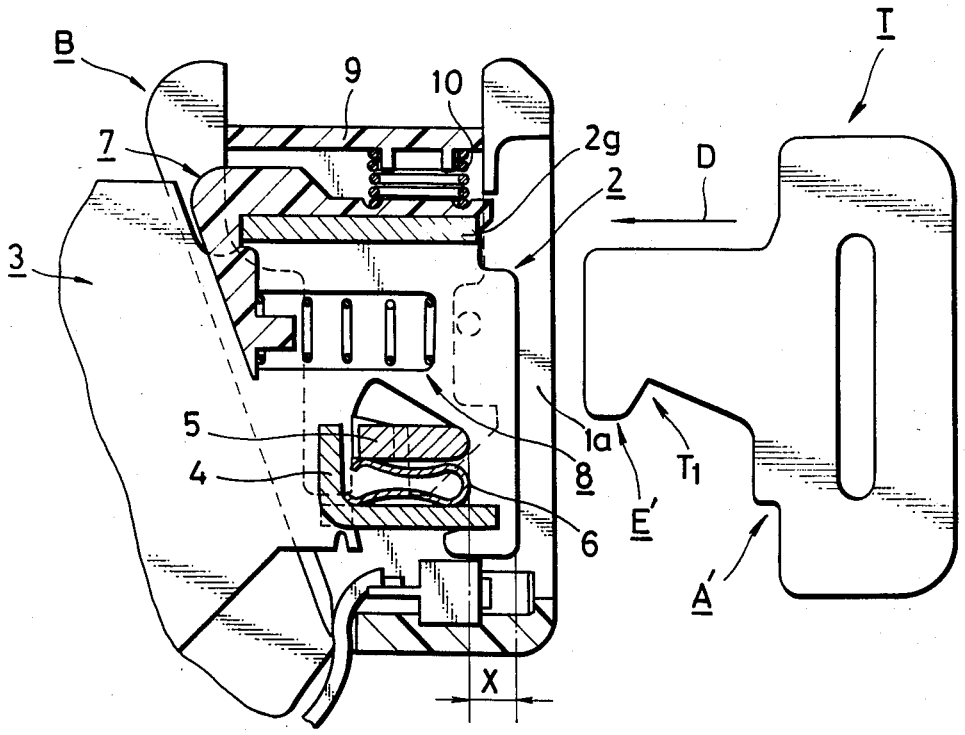
FIG. 2 is a drawing similar to FIG. 1 except that the tongue has been released from the buckle.
Figure 3:
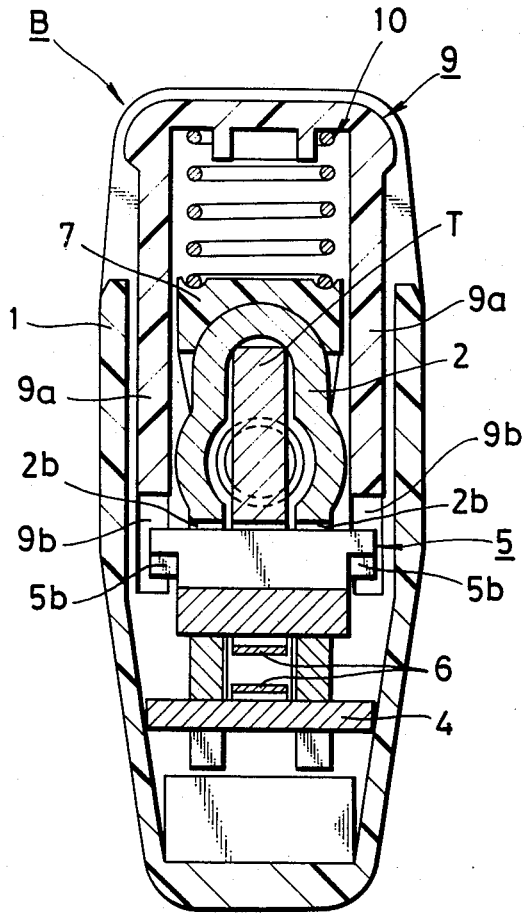
FIG. 3 is a cross-sectional side view of the buckle according to the embodiment of this invention.
Figure 4:
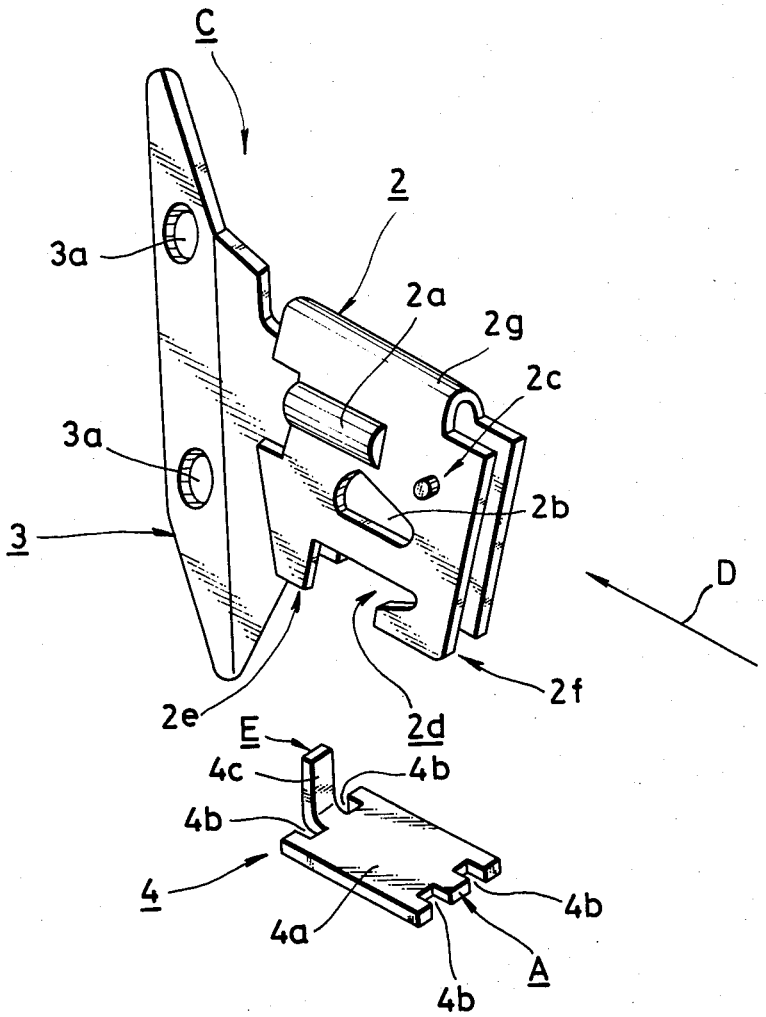
FIG. 4 is a perspective view showing a base 2 and bridge 4 in the buckle according to the embodiment of this invention.

The present invention will hereinafter be described specifically on the basis of one embodiment shown in the accompanying drawings. In FIG. 1, the associated tongue T has been received in the buckle B of a safety belt for a car. On the other hand, the tongue T has been released from the buckle B in FIG. 2. Referring now to FIG. 3, numeral 1 indicates a casing which makes up the outer frame of the buckle B. This casing 1 defines an insertion opening 1*a* (see, FIG. 2) through which the tongue T is releasably fastened to the buckle B. At substantially a central part of the interior of the casing 1, there is provided a base 2 having a substantially U-like cross-section and adapted to receive the tongue T therein. Accordingly, the lower extremity of the base 2 as viewed in FIG. 3 defines an opening which extends along the direction of insertion of the tongue T. The buckle B of this embodiment is designed to facilitate its mounting on a door sash of a car. As illustrated in FIG. 4, an attachment plate 3 which defines bolt holes 3*a* bored therethrough for its fixed mounting on the door sash is therefore formed integrally with the base 2. At predetermined locations, both side walls of the base 2 define respectively guide portions 2*a*, each of which has an arcuate cross-section for the arrangement of an ejector spring 8 (see, FIGS. 1 and 2) adapted to release the tongue T from the buckle B, and sectorial slots 2*b* for turnably supporting a latch piece 5 which is brought into engagement with the tongue T. Both of the side walls of the base 2 are also provided at desired locations with projections 2*c* preventing a below-described release button, which is adapted to release the tongue T, from dropping. In the lower free edges of the side walls, inwardly-widening recesses 2*d* are formed to mount a bridge 4 as a wall member on the base 2.

Although an integral member C (see, FIG. 4) of the attachment plate 3 and base 2 has complex configurations as mentioned above, it may be easily machined in the following manner. First of all, a blank is punched into a desired shape. Here, the paired bolt holes 3*a*, sectorial slots 2*b* and recesses 2*d* are simultaneously punched out. Thereafter, the guide portions 2*a* are formed by the deep-drawing technique and the projections 2*c* are formed as integral members with the base 2 by the stamping technique. The symmetrical base 2 is then folded to bring the paired elements into face-to-face relations respectively so that the integral member C is obtained as depicted in FIG. 4.

The bridge 4, which has a substantially L-like configuration as shown in FIG. 4, is attached to the recesses 2*d* of the base 2. Two notches 4*b* which are brought into engagement with both side walls of the base 2 are formed in each of both ends of the bottom wall of the bridge 4. The inner end of the bridge 4 is extended only at the location flanked by the paired notches 4*b*,4*b* and the thus-extended extended portion is bent up in the vertical direction so as to form an upright lug 4*c*. The open bottom of the base 2 can thus be closed easily by inserting the bridge 4 upwardly into the recesses 2*d* of the base 2 and then bringing the respective notches 4*b* into engagement with the corresponding side walls. In the illustrated embodiment, the bridge 4 can be firmly secured onto the base 2 by clinching the inner corners 2*e* of both sides of the base 2 subsequent to the insertion of the bridge 4 in the recesses 2*d*. Since the recesses 2*d* are inwardly widened from the lower edges of the corresponding side walls of the base 2, it is unnecessary to clinch the other corners, namely, the outer corners 2*f* so that the assembly work is facilitated. As a result of the assembly of the base 2 and bridge 4, a space adapted to receive the tongue T therein is defined by both of the side walls and an upper wall 2*g* of the base 2 and a central part of the bottom wall 4*a* and the upright lug 4*c* of the bridge 4. The base 2 and bridge 4 are designed in such a way that the tongue T is, as illustrated in FIG. 1, supported by both end portions A,E of the bridge 4, namely, by two points and is thus held always in the same position without play. Even when a sudden tensile force is applied from the associated webbing to the tongue T and the tongue T is hence twisted upon occurrence of a collision or the like, the base 2 and bridge 4 can successfully overcome such a twisting deformation of the tongue T and maintain the tongue T in a position kept in engagement with the latch piece 5 (see, FIG. 1 through FIG. 3) which serves as an engagement member. It is therefore possible to avoid any accidental release of the tongue T. Here, a larger load is exerted onto the end portion A of the bridge 4. However, the end portion A is equipped with enough strength to withstand such a larger load because the end portion A and the side walls of the base 2 are fitted to each other so as to fix the bridge 4 structurally on the base 2. Since the bridge 4 and base 2 are discrete members, it is thus possible with ease to make a suitable selection as to the material for the bridge 4 so that the strength of the bridge 4 is increased relative to the strength of the base 2 in order to hold the tongue T with still better reliability. Since the strength of the end portion A which bears large loads is significantly high, it is unnecessary to bear each load in such a manner as distributed over a wide support area. Accordingly, it is possible to design the length X of the base 2, which length X corresponds to the end portion A, as shown in FIG. 2. This is certainly advantageous for reducing the size of the buckle. When the tongue T is of such a shape as having a step between its leading end portion E' and its base portion A' (see, FIG. 2), it is generally required to have two support members respectively for the leading end portion E' and base portion A'. However, a single piece of member is sufficient if the bridge 4 of this invention is employed.

In FIG. 1, the latch piece 5 is turnably inserted and supported in the paired sectorial slots 2*b* of the base 2. The latch piece 5 is brought into engagement with an engagement recess $T_1$ of the tongue T so as to avoid its accidental release. The latch piece 5 is of such a structure that it is reciprocally turnable about its circular end 5*a* as a fulcrum within the range of the radian of the sectorial slots 2*b*, namely, between a latch position shown in FIG. 1 and a non-latch position illustrated in FIG. 2. At the latch position, the latch piece 5 is engageable with the tongue T. At the non-latch position, the latch piece 5 is allowed to release the tongue T from their mutual engagement. In FIG. 3, projections 5*b*,5*b* are formed on both end portions of the latch piece 5, which end portions extend out from their corresponding sectorial slots 2*b*,2*b*. Parts of the release button 9 are kept in engagement with the projections 5*b*,5*b*. Between the latch piece 5 and bridge 4, a latch spring 6 is interposed as a biasing member. The latch piece 5 is normally biased clockwise by the latch spring 6 so that the latch piece 5 assumes the latch position.

In FIG. 1, an L-shaped spring seat 7 is provided in such a way that it extends over the upper surface of the upper wall 2*g* of the base 2 and an upper portion of the inner opening of the base 2. The spring seat 7 contains a dependent portion 7*a* so that substantially upper half portion of the inner opening of the base 2 is closed. A projection 7*b* is formed on the dependent portion 7*a*. One end portion of the ejecting coil spring 8, which facilitates the release of the tongue T, is externally fitted on the projection 7*b*. The coil spring 8 is received in the guide portions 2*a* of the base 2. While the tongue T is fastened to the buckle B, the free end of the coil spring 8 is kept in contact with the tongue T so that the tongue T is always biased in the direction of its release.

On the other hand, a circular groove 7*c* is formed in the spring seat 7 at a location which extends in parallel to the upper wall 2*g* of the base 2. Within the circular groove 7*c*, there is arranged one end of a button spring 10 adapted to cause the release button 9, which serves to release the latch piece 5 and tongue T from their mutual engagement, to return to its inactivated position. The release button 9 has a substantially square U-shaped transverse cross-section and both side walls 9*a*,9*a* of the release button 9 define notches 9*b*,9*b* at their free end portions (see, FIG. 3). While the tongue T is fastened to the buckle B, the both end projections 5*b*,5*b* of the latch piece 5 extend respectively through the notches 9*b*,9*b* in directions perpendicular to the planes in which the corresponding side walls 9*a*,9*a* of the release button 9 lie. When it is desired to release the tongue T from the buckle B, the release button 9 is depressed against the button spring 10 so that the respective recesses 9*b*,9*b* are brought into engagement with their corresponding projections 5*b*,5*b* to have the latch piece 5 assume the non-latch position.

The operation of the buckle of the above-described structure will next be described.

When one wants to fasten the tongue T to the buckle B, the tongue T is held in the position shown in FIG. 2 and is inserted through the insertion opening 1*a* of the casing 1, in the direction indicated by the arrow D, into the base 2 of the buckle B. In the course of its insertion, the tongue T is first of all brought, at its leading corner portion E', into contact with the upper surface of the latch piece 5 which assumes its inclined position. As the tongue T is inserted further, the latch piece 5 is caused to turn counterclockwise against the biasing force of the latch spring 6 owing to the tilted upper surface of the latch piece 5. In this insertion, the tongue T is brought, at its leading edge, into contact with the ejecting coil spring 8 approximately at the same time as the tongue T is brought into contact with the latch piece 5. The tongue T is forcedly inserted further against the biasing force of the ejecting coil spring 8. When the tongue T reaches its received position shown in FIG. 1 and is supported by both end portions A,E of the bridge 4, the latch piece 5 is turned clockwise by the biasing force of the latch spring 6 so that the latch piece 5 is brought into engagement with the engagement recess $T_1$ of the tongue T, whereby the tongue T is firmly held without play in its prescribed receiving position within the base 2.

When one wants to release the tongue T from the buckle B, the release button 9 is depressed in the direction indicated by a thick arrow as shown in FIG. 1. The paired notches *9b,9b,* which are respectively formed in the lower end portions of the side walls *9a,9a,* are then brought into engagement with the corresponding projections *5b,5b* of the latch piece 5 so that the latch piece 5 is turned counterclockwise against the biasing force of the latch spring 6. The latch piece 5 is thus brought into such a non-latch position as shown in FIG. 2, in which the latch piece 5 has been released from its engagement with the tongue T. Accordingly, the tongue T is pushed in a direction opposite to the tongue-inserting direction D by the repulsive force of the ejecting coil spring 8 so that the tongue T is smoothly and readily ejected out from the buckle B.

In the above-described embodiment, the bridge is formed in the L-like configuration. Owing to this configuration, the bridge can, as a single-piece support member, support the tongue at two points although the corresponding edge of the tongue is stepped. This has facilitated the holding of the tongue with better reliability and at the same time, the size reduction of the buckle. According to the present invention, it is thus possible to manufacture, at a low manufacturing cost, compact buckles which can successfully withstand sudden applications of forces and/or moments and can thus hold their associated tongues without failure.

Having now fully described the invention, it will be apparent to one of ordinary skill in the art that many changes and modifications can be made thereto without departing from the spirit or scope of the invention as set forth herein.

What is claimed is:

1. A buckle for releasably receiving a tongue which defines an engagement recess, comprising:

a latch member engageable with the engagement recess;

a base formed in a substantially U-like configuration so as to define an opening in the direction of insertion of the tongue and defining through both side walls thereof support slots for turnably supporting the latch member, said base being adapted to receive the tongue therein;

a bridge secured on the base and extending in the opening of the base, said bridge having engagement portions which when the tongue is in a state kept in engagement with the latch member, are kept in engagement with both first and second portions of the tongue so as to hold the tongue in a received position, said first portion extending from the engagement recess of the tongue toward the leading edge of the tongue and said second portion extending in the opposition direction from the engagement recess;

a biasing member for biasing the latch member so that the latch member assumes a latch position where the latch member is engageable with the engagement recess of the tongue;

release means for turning the latch member against the biasing force of the biasing member so as to release the latch member from the latch position;

wherein both side walls of the base define a pair of inwardly-widening recesses in adjacent to the opening and the bridge has been secured to the base by inserting the bridge in the inwardly-widening recesses and then clinching the side walls at locations adjacent to the mouths of the recesses.

2. A buckle according to claim 1, wherein the bridge member is formed of a plate-like member.

3. A buckle according to claim 1, wherein the bridge defines notches kept in engagement with the corresponding side walls of the base.

4. A buckle according to claim 1, wherein the biasing member is provided between the bridge and latch member.

5. A buckle according to claim 1, wherein the bridge is made of a material having greater strength than the base.

6. A buckle for releasably receiving a tongue which defines an engagement recess, comprising:

a latch member engageable with the engagement recess;

a base formed in a substantially U-like configuration so as to define an opening in the direction of insertion of the tongue and defining through both side walls thereof support slots for turnably supporting the latch member, said base being adapted to receive the tongue therein;

a bridge secured on the base and extending in the opening of the base, said bridge having engagement portions which when the tongue is in a state kept in engagement with the latch member, are kept in engagement with both first and second portions of the tongue so as to hold the tongue in a received position, said first portion extending from the engagement recess of the tongue toward the leading edge of the tongue and said second portion extending in the opposition direction from the engagement recess;

a biasing member for biasing the latch member so that the latch member assumes a latch position where the latch member is engageable with the engagement recess of the tongue;

release means for turning the latch member against the biasing force of the biasing member so as to release the latch member from the latch position;

wherein the first and second portions of the tongue are formed on different levels relative to the direction perpendicular to the length of the tongue, and the bridge is formed in a substantially L-like configuration so that the first and second portions of the tongue are engageable respectively with both ends of the bridge.

7. A buckle according to claim 6, wherein the bridge member is formed of a plate-like member.

8. A buckle according to claim 6, wherein the biasing member is provided between the bridge and latch member.

9. A buckle according to claim 6, wherein the bridge is made of a material having greater strength than the base.

* * * * *